United States Patent [19]

Hesky et al.

[11] 4,396,541

[45] Aug. 2, 1983

[54] STORAGE OF LIQUID, RADIOACTIVE WASTES

[75] Inventors: Hans Hesky, Runkel; Armin Wunderer, Hofheim am Taunus, both of Fed. Rep. of Germany

[73] Assignee: Hoechst Aktiengesellschaft, Frankfurt am Main, Fed. Rep. of Germany

[21] Appl. No.: 83,851

[22] Filed: Oct. 11, 1979

[30] Foreign Application Priority Data

Oct. 13, 1978 [DE] Fed. Rep. of Germany ..... 2844608

[51] Int. Cl.[3] ..... G21F 9/22

[52] U.S. Cl. ..... 252/633; 252/630; 252/631; 252/632

[58] Field of Search ..... 252/631, 632, 633, 630

[56] References Cited

U.S. PATENT DOCUMENTS 3,706,630 12/1972 Cohen et al. ..... 252/630
3,932,300 1/1976 Gotchy ..... 252/633
4,178,350 12/1979 Collins et al. ..... 252/630

FOREIGN PATENT DOCUMENTS 1129342 10/1968 United Kingdom ..... 252/633

OTHER PUBLICATIONS

Tosetti, "Gaseous Waste Treatment" in Moghissi et al., Eds. *Nuclear Power Waste Technology,* Amer. Soc. of Mech. Engrs. N.Y. 1978, pp. 201–209.

*Primary Examiner*—Deborah L. Kyle
*Attorney, Agent, or Firm*—Curtis, Morris & Safford

[57] ABSTRACT

When reprocessing spent nuclear fuel, liquid radioactive wastes are obtained and within the wastes heat is generated from fission, and oxyhydrogen may be set free by radiolysis. The fission heat generated within the liquid wastes is carried off by evaporation cooling and, the vapor so formed is condensed and recycled into the storage vessel for the liquid wastes. The oxyhydrogen is then diluted with the vapor formed during evaporation cooling and converted catalytically.

9 Claims, 1 Drawing Figure

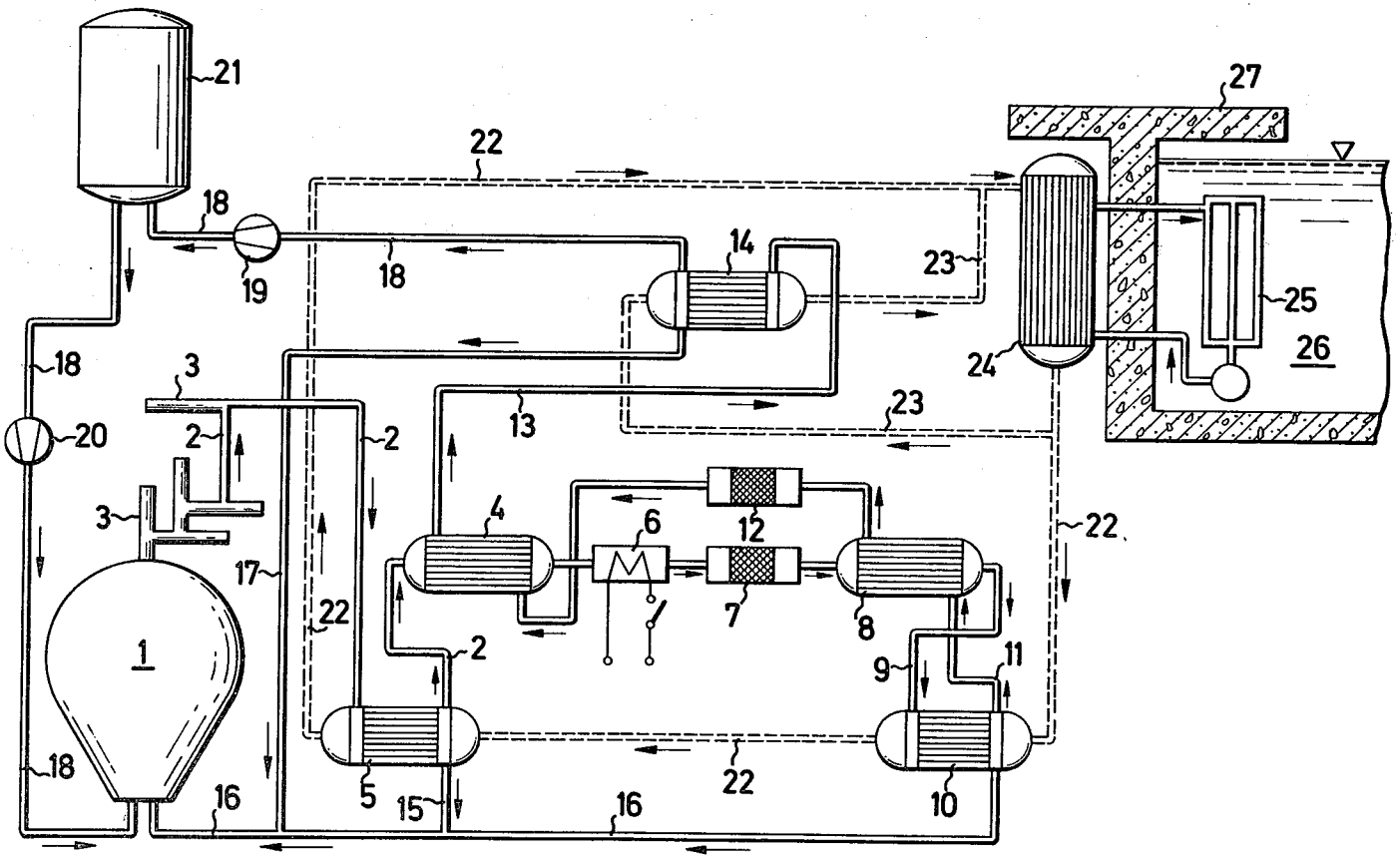
1
2
3
4
5
6
7
8
9
10
11
12
13
14
15
16
17
18
19
20
21
22
23
24
25
26
27

STORAGE OF LIQUID, RADIOACTIVE WASTES

The present invention relates to a process permitting the storage of liquid radioactive wastes obtained from reprocessing spent nuclear fuel and during which oxyhydrogen may be formed by radiolysis.

Liquid wastes which remain after reprocessing of spent nuclear fuel are corrosive, self-heating and radioactive. When they are stored, hydrogen and oxygen are set free by radiolysis. Mixtures of hydrogen and oxygen (i.e., so-called oxyhydrogen) may then be formed and such mixtures involve the risk of explosion and detonation; furthermore, heat is generated to a high degree. Additionally, sediments are formed.

In order to prevent the formation of such oxyhydrogen mixtures which involve the risk of explosion and detonation, air or nitrogen are conventionally introduced into the liquid radioactive wastes. One portion of these gases is used for emulsifying the sediments. The heat generated by radioactive fission is carried off by indirect cooling through the wall of the vessel and additional heat exchange surfaces within the vessel. A disadvantage of the known processes is that great amounts of radioactive substances are released with the gases into the atmosphere. Even if the released gas is filtered, it must be taken into account that a 100% filtering effect cannot be reached, so the radioactivity set free represents a considerable environment pollution. This environment pollution is the higher, the greater the quantity of any released gas is. And, consequently, the higher the quantity of released gas, the more filter material must be decontaminated.

Another disadvantage is the indirect cooling on cooling surfaces. The cooling surfaces, especially those of internal coolers in the form of smooth and/or ribbed pipes suspended in the vessels and provided with many welding seams, are subject to corrosion caused by the liquid wastes. In order to prevent corrosion failures, the vessels have been provided with cooling systems arranged separately from each other so that each of them could indepedently provide the full cooling power required. Nevertheless, these cooling systems have the disadvantage that sediments may encrust the surfaces, and thereby drastically reduce the cooling effect and, moreover, may also provoke undesired radioactive and thermic loads.

Another disadvantage is the dependence on energy sources which are subject to failures and which, in the known processes, are used for driving pumps and blowers.

An object of this invention was to find a way to store liquid, radioactive wastes which does not involve the aforementioned disadvantages and which, especially in the case of disturbances, for example failures of pumps and blowers, safeguards a sufficient cooling effect and in which the quantity of waste gas is just a fraction of gas contained in the system.

This task is solved according to the invention by carrying off, by evaporation cooling, the heat resulted by fission in the liquid wastes, condensing the vapor formed and recirculating the condensation product into the storage vessel for the liquid wastes.

Evaporation cooling can be effected by boiling the liquid wastes and/or the recirculated condensation product. The vapor formed during this cooling process may be used for diluting the oxyhydrogen mixture formed by radiolysis. The oxyhydrogen itself can then be converted catalytically into water. For this purpose, it may be of advantage to enrich the oxyhydrogen mixture by partial condensation of the vapor in the vapor-oxyhydrogen mixture before the catalytical conversion. The mixture of vapor and oxyhydrogen may be heated prior to the conversion of the oxyhydrogen, preferably by the heat formed during the conversion. It may be of advantage to catalytically convert the oxyhydrogen in two stages, i.e. so that the vapor-oxyhydrogen mixture is partially condensed between these stages and heated by the gas mixture flowing into each stage using the heat formed in the other catalytic conversion stage.

The advantage of the process of the invention resides in the fact that the vapor mixture leaving the store container is recycled as condensation product and, optionally as flushing gas, into the storage vessel. The cooling system operates fully independent from outer energy. The small, not condensable portions of the steam-gas mixture are used as flushing gas for bubble stirring the store container to prevent sedimentation. Nitric oxides and nitric acid vapors formed by radiolysis can be removed, if desired, from the vapor-gas mixture or from the condensation product.

Since, in general, the boiling point of the condensation product is lower than that of the liquid wastes, it may be of advantage to perform cooling just by boiling the condensation product. The dragging-in of small radioactive droplets from the liquid wastes into the vapor space of the storage vessel is thereby prevented. If the wall of the store container is used as heat exchanger surface, at the outer side of which the condensation product is vaporized a convection stream is produced in the inner space which is counter-directed to the sedimentation of solid particles. The vapor formed by the vaporization of the condensation product is used as dilution gas. Vaporization of the condensation product may also be carried out within the liquid wastes in corresponding heat exchanging apparatus. Since the vapor may be passed into the storage vessel, no requirements with regard to tightness are necessary for such an exchange system.

The sole drawing FIGURE is a schematic illustration of one embodiment of the system according to this invention for storing liquid radioactive wastes.

Referring to the drawing FIGURE, the radioactive liquid waste is contained in a storage vessel (1) which, preferably, has the form of an inverted pear. Heat generated by fission is removed by evaporation cooling, and oxyhydrogen formed by radiolysis is diluted by the vapor formed during boiling. The vapor-oxyhydrogen mixture is passed through a take off port at the rounded top end of the storage vessel (1) and over conduit (2), which may be provided with detonation locks (3), to a first heat exchanger (4) which may be preceded by condenser (5). Therefrom, the vapor-oxyhydrogen mixture is passed, optionally through an electric heater (6), into a first oxidation-catalysis stage (conversion stage) (7). The oxyhydrogen-poor mixture leaving the first catalysis stage (7) is then led to a heat-exchanger (8) and thence over a conduit (9) to a second condenser (10). The gas mixture which leaves the second condenser (10) is passed through a pipe (11) into another path in the heat exchanger (8), where it is heated and then eventually reaches a second catalytic conversion stage (12). The gas mixture, which is now poor in oxyhydrogen, leaves the second catalysis stage (12) and is then passed through a second path in the heat exchanger (4) and hence through a conduit (13) into a third condenser (14). The condensation product formed in the condensers (5), (10) and (14) is recycled via pipes (15), (16) and (17) into a liquid inlet at the pointed bottom of the storage vessel (1). The uncondensed portion of the gas mixture is recycled through a pipe (18) as flushing gas into a gas inlet at the bottom of the storage vessel (1). The conduit (18) may be provided with blowers (19) and (20) as well as with a gas container (21). The blower (19) reduces the pressure in the storage vessel (1). A lowering of the pressure, which may lead to a lowering of the boiling point to about 45° C., reduces the risk of corrosion within the system. The condensers (5), (10) and (14) are connected to a cooling circuit (22), (23), which is marked in the drawing by the double broken lines. A heat exchanger (24) may be arranged in the cooling circuit (22), (23), which is connected over a secondary circuit (25) with a cooling source (26), for example a pond.

The symbol (27) represents a protective measure for the heat exchanger (24) and the secondary circuit (25). In the case of power failure, the cooling circuits can operate independently by thermo-syphone action.

We claim:

1. Process for storing, in a closed system, liquid radioactive wastes obtained from reprocessing spent nuclear fuel and in which oxyhydrogen is formed by radiolysis of the liquid wastes comprising the steps of holding the liquid wastes in a storage vessel having a take-off outlet at the top thereof, and at least one inlet at the bottom thereof, with a conduit coupling said take off outlet to a condenser for condensing at least a portion of vapors of an evaporated condensation liquid carried thereto from said container vessel;

reducing the pressure in said conduit so that the pressure in said storage vessel is maintained at or below the boiling point of said condensation liquid and so that fission-generated heat in the liquid wastes is carried off by evaporation of said condensation liquid;

passing said vapors together with the oxyhydrogen through said condenser to condense at least a part of said vapors to a liquid and to remove said fission-generated heat from said vapors;

recombining to water the oxyhydrogen contained in said vapors;

returning uncondensed vapors from said condenser to said storage vessel; and returning the condensed liquid from said condenser, and the recombined water, to a liquid inlet at the bottom of said storage vessel.

2. Process for storing liquid radioactive wastes as claimed in claim 1; wherein said uncondensed vapors are returned from said condenser to a gas inlet at the bottom of said storage vessel.

3. Process for storing liquid radioactive wastes as claimed in claim 2; wherein said oxyhydrogen is diluted in said storage vessel with the vapors formed by evaporation of said liquid, and is carried into said conduit with said vapors; and the steps of recombining includes passing the uncondensed gas vapor with said oxyhydrogen therein through at least one catalytic converter to convert the oxyhydrogen to water vapor, with the condenser serving to enrich the oxyhydrogen by at least partially condensing the vapors of the condensation liquid.

4. Process for storing liquid radioactive wastes as claimed in claim 3; wherein said step of passing the vapors and oxyhydrogen through at least one catalytic converter includes passing the gas vapor through a loop arrangement of first and second catalytic converters alternating with first and second heat exchangers, with the first heat exchanger being coupled to the first-mentioned condenser and the second heat exchanger being coupled to a second condenser, such that the gas vapor and converted water vapor are partially condensed between the first and second converters, and so that the oxyhydrogen flowing to the first and second converters is preheated in the first and second heat exchangers by means of heat generated in the second and first converters, respectively.

5. Process for storing liquid radioactive wastes as claimed in claim 4; wherein the step of passing said vapors and oxyhydrogen through at least one catalytic converter includes passing the vapors and oxyhydrogen through one path of said first heat exchanger, passing the vapors therefrom through said first converter and thence into a first path of said second heat exchanger, passing the vapor and oxyhydrogen therefrom to said second condenser in which the vapors and recombined water are at least partially condensed to enrich the oxyhydrogen, returning the condensed liquid from the second condenser to said storage vessel, passing the uncondensed vapors and the oxyhydrogen from said condenser through a second path in said heat exchanger and thence through said second converter and through a second path in said first heat exchanger.

6. Process for storing liquid radioactive wastes as claimed in claim 4 or claim 5; wherein said vapors are passed from said first heat exchanger to a third condenser in which the gas vapor is at least partially condensed to said liquid, and the condensed liquid and remaining uncondensed vapor are returned through separate conduits to the bottom of said storage vessel.

7. Process for storing liquid radioactive wastes as claimed in claim 4; further comprising electrically heating the oxyhydrogen immediately before passing the same through one of said first and second converters.

8. Process for storing liquid radioactive wastes as claimed in claim 2, wherein said step of reducing the pressure includes operating a first blower disposed in said conduit to pump the vapors to a gas container, and operating a second blower disposed in a gas return conduit connecting said gas container and the gas inlet at the bottom of said storage vessel to supply said vapors thereto as a flushing gas.

9. Process for storing liquid radioactive wastes as claimed in claim 1, wherein said storage vessel is generally pear shaped with a rounded end on top and a pointed end on the bottom and with said at least one inlet disposed at said pointed end.

* * * * *